United States Patent [19]

Larson

[11] 4,222,460

[45] Sep. 16, 1980

[54] EXTENSION LADDERS

[75] Inventor: Clayton E. Larson, Brooklyn, N.Y.

[73] Assignee: White Metal Rolling and Stamping Corp., Brooklyn, N.Y.

[21] Appl. No.: 38,899

[22] Filed: May 14, 1979

[51] Int. Cl.[2] ..... E06C 7/06; E06C 1/12

[52] U.S. Cl. ..... 182/211

[58] Field of Search ..... 182/209–213

[56] References Cited

U.S. PATENT DOCUMENTS

| | | | |
|---|---|---|---|
| 864,194 | 8/1907 | Reimann | 182/211 |
| 1,457,100 | 5/1923 | Bolger | 182/211 |
| 1,950,574 | 3/1934 | Smith | 182/210 |

*Primary Examiner*—Reinaldo P. Machado
*Attorney, Agent, or Firm*—Carroll F. Palmer

[57] ABSTRACT

The fly sections of extension ladders are provided at the bottom end with opposed housing bars upon which a rung is mounted thereby avoiding the usual hazard of a skipped rung. The housing bars are constructed and mounted on the fly section to provide multi-directional strength while permitting full movement, in the space between the mounting bar and the ladder side rail, of automatic hook locks equipped with conventional toggles. The improved constructions are especially suited to the manufacture of all-metal ladders.

7 Claims, 6 Drawing Figures

FIG. 5
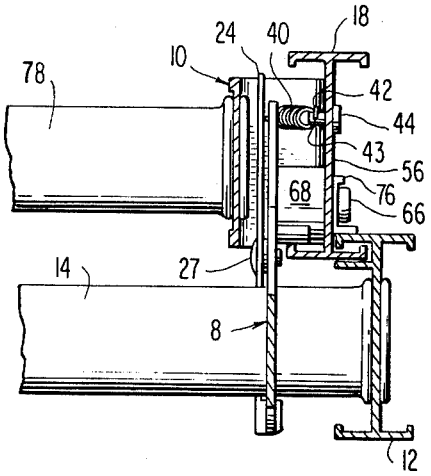
FIG. 4.
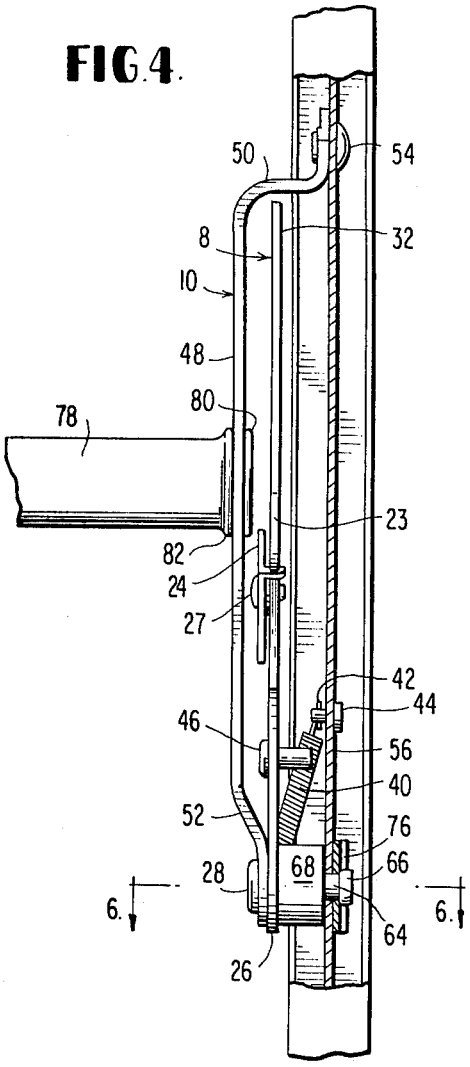
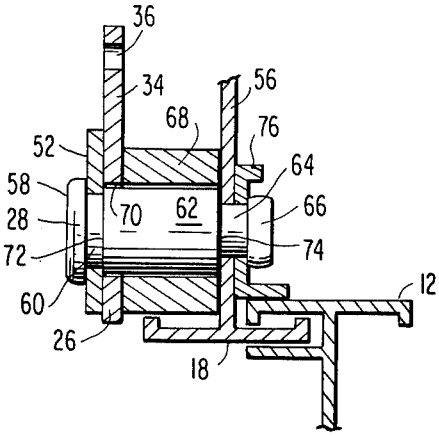
FIG. 6

EXTENSION LADDERS

BACKGROUND OF THE INVENTION

1. Field of the Invention

This invention relates to extension ladders. More particulary, it concerns extension ladders with automatic hook locks for length adjustment combined with housing bars and an adjacent rung thereby avoiding the hazard of a skipped rung.

2. Description of the Prior Act

It is conventional practice in the manufacture of extension ladders to use automatic hook locks of the tension type to enable the position of the fly section of the ladder to be varied relative to the bed section. Such hook locks can be compact, safe and durable with low maintenance requirements, except an occasional lubrication. They are conveniently adaptable to positive spring biasing toward a locking position providing a dependable positioning arrangement when the fly section is placed behind the bed section, which in turn contributes to safety and convenience in use of the ladder.

Such hook locks also maybe used with the fly section in front of the bed section, but the conventional omission of one rung (a skipped rung) in the fly section to provide space for the hook locks to operate creates a safety hazard and diminishes the convenience and ease of use of the ladder.

The safety hazard created by a skipped rung in the fly section of an extension ladder is particularly serious when the fly section is used separately from the bed section as a separate straight ladder. This has resulted in enactment of regulations requiring that extension ladders with a skipped rung be equipped with positive stops to prevent disassembly of the fly section from the bed section.

The problems associated with extension ladders having a skipped rung have been long recognized and ladders have been designed to allow extension ladders to have automatic locking devices without need for a skipped rung (see U.S. Pat. Nos. 968,040 and 1,457,100). However, ladder constructions that require highly specialized hooks or that limit the extent of movement of the locks are not generally accepted by ladder manufactures or ladder users. Even though there have been prior art extension ladders without skipped rungs, most extension ladders currently available with automatic hook locks do involve a skipped rung in the fly section. Hence, improvements in the construction of extension ladders are needed to eliminate skipped rungs in the fly section and, at the same time, provide ladders that are strong, safe, and easy to use while being acceptable to both ladder manufacturers and users.

OBJECTS

A principal object of this invention is the provision of extension ladders having automatic position adjustment, hook locks without a skipped rung in the fly section.

Another object is the provision of such extension ladders that provide multi-directional strength for the hook locks and an adjacent rung and also permit full movement of a standard type of hook lock complete with a conventional toggle.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished according to the present invention by the provision of extension ladders having a bed section and a fly section and which comprise a pair of automatic hook locks, a pair of housing bars of special shape fixed at the bottom of the fly section in opposed position inside the ladder side rails and a step member fixed transversely of the side rails upon the housing bars. Such step member is spaced in conformance with the other step members of the ladder.

The housing bars define spaces between the side rails and themselves, which spaces are free of interference from any step members and in which the automatic hook locks can perform full standard type of locking and unlocking movements. The hook locks are pivoted at their lower ends upon rivets that serve, together with spacer rings, to connect the lower end of the housing bars to the fly section side rails. This arrangement serves to reinforce the hook mounting and to allow for counter-opposed loading forces that effectively neutralize the load on the mounting point.

BRIEF DESCRIPTION OF THE DRAWINGS

A more complete understanding of the new extension ladders of the invention may be had by reference to the accompanying drawings in which:

FIG. 4 is a fragmentary, sectional view taken on the line 4—4 of FIG. 3.

FIG. 5 is a fragmentary, sectional view taken on the line 5—5 of FIG. 3.

FIG. 6 is a sectional view taken on the line 6—6 of FIG. 4.

DESCRIPTION OF PREFERRED EMBODIMENTS

Figure 1:
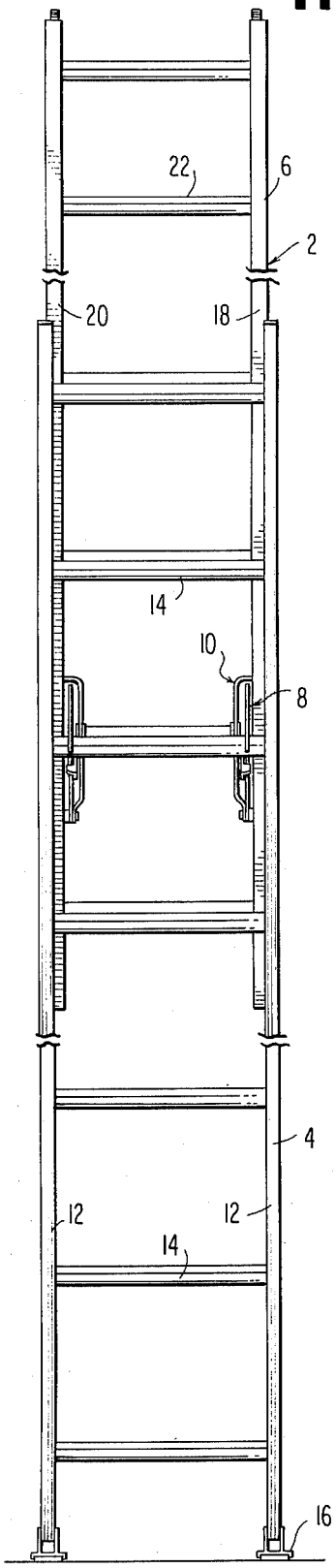
FIG. 1 is a lateral view of an extension ladder constructed in accordance with the invention.
Figure 2:
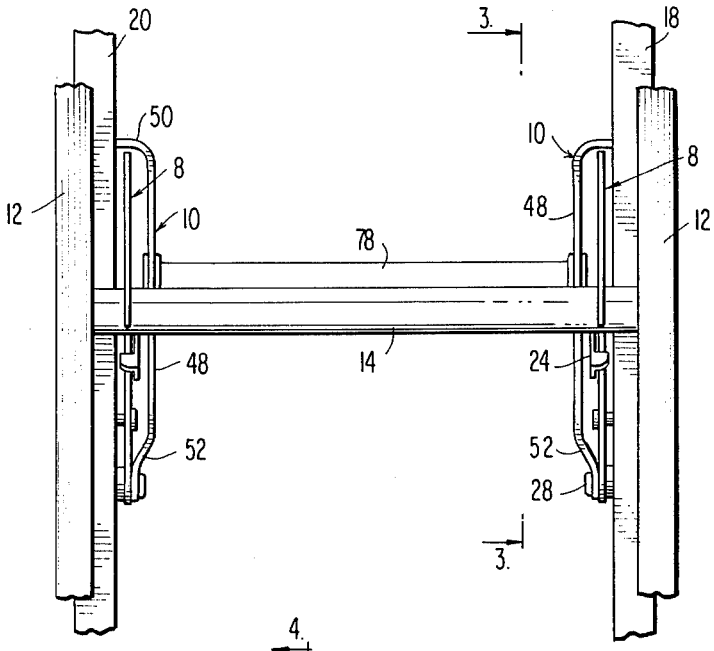
FIG. 2 is a fragmentary lateral view of the hook lock portion of the ladder of FIG. 1.

Referring in detail to the drawings, the extension ladder 2 comprises a bed section 4 and a fly section 6, automatic hook locks 8 and housing bars 10.

The bed section 4 is formed of a pair of parallel side rails 12, a plurality of equally spaced apart step members 14 fixed transversely upon the side rails 12 and pivoted foot pads 16. In substance, the bed section 4 is conventional in art. The step members 14 are shown as having a trapezodial cross-section, but round or square rungs may be used. The step members are fixed to the side rails by expanded joints or in any other suitable manner known to the art.

The fly section 6 is formed of first and second parallel side rails 18 and 20 with plurality of transverse step members 22 fixed upon the side rails spaced apart equivalent to the spacing of the step members 14 of bed section 4. These portions of the fly section 6 are conventional in the art.

The automatic hook locks 8 comprise a hook portion 23 and a toggle 24 pivotally carried by rivet 7 on the hook portion 23. The lower end 26 of hook portion 23 is pivoted on the compount rivet 28 and the free upper end 30 carries the by-pass projection 32. The lower end 26 has an integral ear 34 with hole 36 to which the lower end 38 of spring 40 is fastened. The other end 42 of spring 40 extends through a hole 43 in the pin 44 carried in a hole in the side rail 18. A long stem rivet 46 fixed in the hook lock lower end 26 serves to limit the extent to which the spring 40 can move the hook lock 8 toward the bed section 4.

The housing bars 10 comprise a substantially flat central web portion 48, an L-shaped upper end 50 and a lower end 52 that is off-set from the web portion 48 in the same direction as the upper end 50. The upper end 50 of one of the pairs of housing bars 10 is fixed by rivet 54 to the central web 56 of the side rail 18 and the upper end 50 of the opposed housing bar 10 is similarly riveted to the central web of side rail 20 of fly section 6.

The complex rivets 28 form the pivot support for the hook locks 8, as well as support for the lower ends 52 of housing bars 10. They have a wide head 58, a concentric outer recess 60, a barrel portion 62, a concentric tail 64 and a compressed button 66. A spacer ring 68 encircles the barrel portion 62 and the lower end 26 of hook lock 8 contains a bore 70 sized so that the lower end 26 may also encircle the barrel portion 62. The length of portion 62 between outer shoulder 72 and inner shoulder 74 is just slightly greater than the combined width of lower end 26 and spacer ring 68. Hence, when the compound rivet 28 has been compressed so that head 58 locks housing bar lower end 52 in the recess 60 and side rail central web 56 and reinforcement member 76 are locked between button 66 and inner shoulder 74, the lower end 26 can freely pivot in the barrel portion 62. This mounting arrangement for the mounting bars 10 and hook locks 8 create multi-directional strength for these units of the fly section 6 while still allowing wide movement for the hook locks 8. Also, the spacer rings 68 give lateral support to the hook locks 8 while providing that the hook locks clear the side rails 12 of the bed section 4 as they pivot in the space between the mounting bars 10 and the side rails 18 and 20 of the fly section 6.

The step member 78 is fixed between the central web portions 48 of the housing bars 10 transversely of the side rails 18 and 20 of the fly section 6 with the spacing between step member 78 and other step members 22 of fly section 6 in conformance with the spacing of step members 14 of the bed section 4. The step member 78 is preferrably fixed to the central web portion 48 to be expanded portions 80 and 82, but any other suitable method of fixing the step member 78 on mounting bars 10 may be used.

Figure 3:
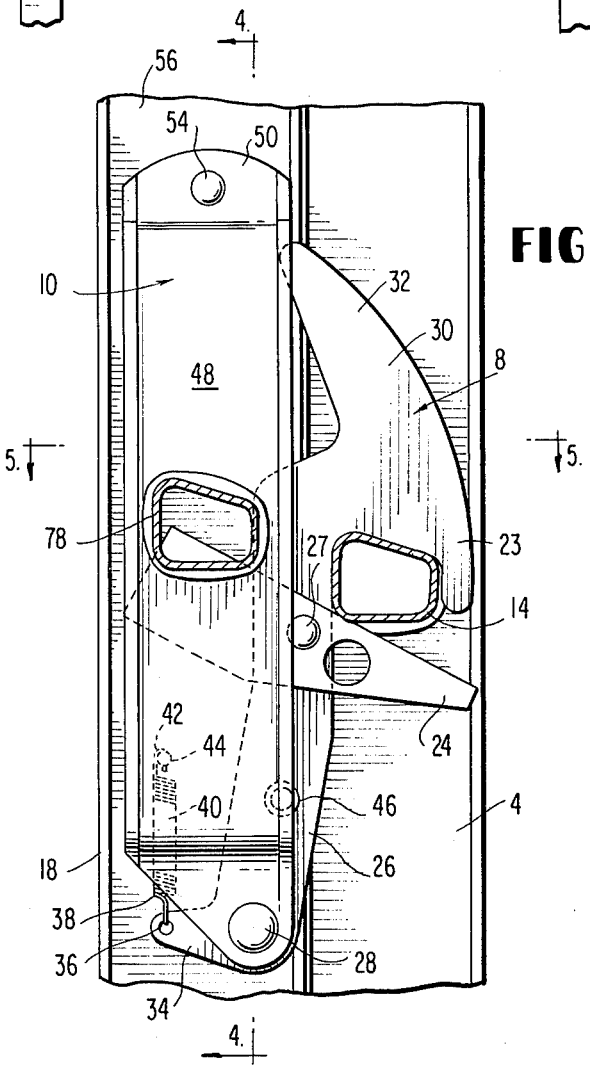
FIG. 3 is a fragmentary, sectional view taken on the line 3—3 of FIG. 2.

The use of an extension ladder of the invention follows the conventional pattern. To extend the fly section 6 on the bed section 4, the fly section is pulled up, usually by a rope (not shown) with the pass-by projections 32 of the hook locks 8 moving them around step members 14 as the ascent of fly section 6 is made. At the desired extension, the hook portion 23 of hook locks 8 will hook on a step 14 of bed portion 4 (see FIG. 3). When the user climbs the extended ladder and stands on the fly section 6, the weight of the user is suported by the hook locks 8. The forces imposed on the hook locks are handled in a multidirectional manner by the described arrangement of the mounting bars 10, compound rivets 28, reinforcement members 76, and spacer rings 68.

To lower the fly section 6 on the bed section 4, the fly section 6 is raised until the toggle 24 goes above the step member 14 and drops into position covering the hook portion 23 of hook locks 8. The toggles 24 then allow the hook locks 8 to by-pass the step members 14 as long as the fly section decends on the bed portion 4.

Since there is no skipped rung in the fly section 6 of the new ladders, the bed section 4 and fly section 6 may be disconnected and used as separate, single length ladders without the safety hazard associated with ladder sections having skipped rungs.

The embodiments of the invention in which an exclusive property or privilege is claimed are defined as follows:

1. In an extension ladder having a bed section formed of a pair of parallel side rails and a plurality of equally spaced apart step members fixed transversly upon the side rails and a fly section formed of first and second parallel side rails and a plurality of transverse step members fixed upon the side rails spaced apart equivalent to the spacing of the step members of said bed section, the improvement which comprises:

a pair of automatic hook locks each comprising
a hook portion having a pivoted lower end and a free upper end,
a toggle pivotally carried on said hook portion and spring means to bias the hook lock into locking position,
a pair of opposed housing bars each comprising:
a substantially flat central web portion,
an L-shaped upper end and
a lower end that is off-set from said web portion in the direction of said upper end,
the upper end of one of said housing bars being fixed to the inner face of said first side rail of said fly section and the upper end of the other of said housing bars being similarly fixed to the inner face of said second side rail of said fly section,
spacer rings positioned between the inner faces of said fly section side rails and said lower ends of said housing bars,
rivets extending through said spacer rings connecting said housing bar lower ends to the respective fly section side rail,
each said hook lock being located in the space between the inner face of a fly section side rail and the central web portion of a housing bar with the pivoted lower end of the hook lock positioned between said spacer ring and said housing bar lower end and with one of said rivets extending through the hook lock lower end, and
a step member fixed between the central web portions of said opposed housing bars transversly of the side rails of said fly section in conformance, relative to the step members of said fly section, with said spacing of the step members of said bed section.

2. The extension ladder of claim 1 wherein all the parts thereof are made of metal.

3. The extension ladder of claim 2 wherein said metal is aluminum alloy.

4. The extension ladder of claim 1 wherein said step members are tubular.

5. The extension ladder of claim 4 wherein the tubular step members have a trapezoidal cross-section.

6. The extension ladder of claim 5 wherein the step surface of the tubular step members is longitudinally serrated.

7. The extension ladder of claim 6 wherein said tubular step member extending between said housing bars is mounted upon said housing bars by means of expanded joints.

* * * * *